US006447381B1

(12) United States Patent
Kubo

(10) Patent No.: US 6,447,381 B1
(45) Date of Patent: Sep. 10, 2002

(54) POLISHING APPARATUS

(75) Inventor: Akira Kubo, Tokyo (JP)

(73) Assignee: NEC Corporation, Tokyo (JP)

( * ) Notice: Subject to any disclaimer, the term of this patent is extended or adjusted under 35 U.S.C. 154(b) by 63 days.

(21) Appl. No.: 09/691,102

(22) Filed: Oct. 19, 2000

(30) Foreign Application Priority Data

Oct. 21, 1999 (JP) ..... 11-300290

(51) Int. Cl.[7] ..... B24B 5/00

(52) U.S. Cl. ..... 451/288; 451/36; 451/285; 451/287; 451/60

(58) Field of Search ..... 451/285–289, 451/60, 41, 72, 443–444, 36, 59, 550, 446; 156/636; 51/309

(56) References Cited

U.S. PATENT DOCUMENTS 4,435,247 A * 3/1984 Basi et al. ..... 156/636
4,869,779 A * 9/1989 Acheson ..... 156/636
5,232,875 A * 8/1993 Tuttle et al. ..... 451/41
5,584,898 A * 12/1996 Fulton ..... 51/309
5,755,614 A * 5/1998 Adams et al. ..... 451/60
6,015,499 A * 1/2000 Hayden ..... 451/60
6,019,665 A * 2/2000 Lee et al. ..... 451/36
6,149,508 A * 11/2000 Vanell et al. ..... 451/72

FOREIGN PATENT DOCUMENTS

| | | |
|---|---|---|
| JP | 4-313224 | 11/1992 |
| JP | 7-156045 | 6/1995 |
| JP | 9-314466 | 12/1997 |
| JP | 2903980 | 3/1999 |

* cited by examiner

*Primary Examiner*—Joseph J. Hail, III
*Assistant Examiner*—Lee Wilson
(74) *Attorney, Agent, or Firm*—Young & Thompson

(57) ABSTRACT

In a polishing apparatus, a wafer is sustained by a wafer carrier and the wafer is ground with a polishing pad which is rotationally driven. A slurry is fed on to the polishing pad through a slurry feed nozzle. A filter is disposed upstream from the wafer in the direction of rotation of the polishing pad and traps the swarf generated on the polishing pad. A defense barrier is provided around the polishing pad to prevent the slurry on the polishing pad from spilling out therefrom during polishing and thus retains the slurry thereon, thereby recycling the slurry on the polishing pad.

9 Claims, 4 Drawing Sheets

POLISHING APPARATUS

BACKGROUND OF THE INVENTION

1. Field of the Invention

The present invention relates to a polishing apparatus for use in polishing a semiconductor substrate and more particularly to a polishing apparatus which allows recycling of slurry on the polishing pad.

2. Description of the Related Art

Generally, to reduce the cost in polishing processes, abrasives or slurries (liquid abrasives) containing abrasives are recycled for repeated use.

An abrasive has been suggested which is suitable for such recycling in that the abrasive provides less reduction in efficiency of polishing and secures a sufficient rate of polishing when recycled (Japanese Patent Laid-Open Publication No. Hei 4-313224). On the other hand, various techniques for recycling slurries have been suggested (Japanese Patent Laid-Open Publications No. Hei 7-156045 and No. Hei 9-314466, and Japanese Patent No. 2903980).

FIG. 1 illustrates a prior-art ultrasonic abrasives polishing apparatus disclosed in Japanese Patent Laid-Open Publication No. Hei 7-156045. An ultrasonic propagation liquid 106 is filled in an ultrasonic propagation tank 105 with an ultrasonic vibrator 102 arranged on the bottom thereof. In addition, an abrasive tank 100 in which an abrasive liquid 101 is filled is immersed in the ultrasonic ropagation liquid 106 in the ultrasonic propagation tank 105. The abrasive liquid 101 is adapted to return to an agitator tank 103 via a pipe and a valve, which are provided under the bottom of the abrasive tank 100. In the agitator tank 103, provided is a magnetic separator 104 for filtering out foreign substances in the abrasive liquid. After the foreign substances in the abrasive liquid 101 have been filtered out, the abrasive liquid 101 stored in the agitator tank 103 is forced by a pump 107 to a vacuum deaerator 108, where the abrasive liquid 101 is deaerated by the vacuum deaerator 108. Thereafter, the abrasive liquid 101 is fed to the abrasive tank 100. Thus, the abrasive liquid 101 is circulated for use.

In addition, in Japanese Patent Laid-Open Publication No. Hei 9-314466, disclosed is a semiconductor wafer polishing apparatus which filters out impurities in an abrasive liquid to circulate the abrasive liquid. FIG. 2 is a schematic view illustrating the prior-art polishing apparatus. In the polishing apparatus, a platen 112, to the upper surface of which a polishing pad 113 is affixed, is adapted to be rotationally driven by rotary drive means (not shown). A weight 111 is adapted to press a wafer 110 against the upper surface of the platen 112. Under the platen 112, provided is a slurry pan 114 for receiving a slurry 116 drained from the polishing pad 113. The slurry pan 114 is coupled to a slurry tank 117 via a slurry collecting pipe 115. The lower end of a feed pipe 122 is immersed in the slurry 116 in the slurry tank 117. The feed pipe 122 is connected to heavy metal ion filter means 120 via a pump 121. Heavy metal ions generated during polishing are trapped and filtered out with the filter means 120, and thereafter the slurry 116 is fed through the feed pipe 122 onto the polishing pad 113 from a slurry feed port 119. Incidentally, the heavy metal ion filter means 120 comprises a column with polymers filled and sealed therein, being adapted to filter out heavy metal ions with the polymers. Thus, the slurry 116 is circulated for use.

FIG. 3 illustrates a prior-art polishing apparatus described in Japanese Patent No. 2903980. There are provided a reservoir 136 for storing a slurry 131 at the center of a platen 137 and a polishing pad 138 on the upper surface of the platen 137. A wafer 130 is adapted to be pressed against the polishing pad 138. On the outer circumference surface of the platen 137, a funnel 139 for collecting the slurry is provided around the platen 137. Further outside the funnel 139, provided is a receiver tank 140 for receiving a spill-over of the spilt slurry 131. In addition, a waste liquid tank 132 collects a waste liquid, which has been used for polishing, from the receiver tank 140. The slurry waste liquid in the waste liquid tank 132 is drained to the outside via a drain pipe (not shown). In addition, the slurry 131 collected in the funnel 139 returns to the reservoir 136 through a pipe 141 which connects the funnel 139 to the reservoir 136. This allows the slurry 131 to be recycled.

A slurry tank 135 stores the slurry 131, which is fed to the reservoir 136 by means of a pump 133. Furthermore, the slurry 131 in the reservoir 136 is fed onto the polishing pad 138 by means of a pump 134.

In this prior art, only the same amount of the slurry 131 as that used for polishing is fed by the pump 134 from the reservoir 136 onto the polishing pad 138. The slurry 131 collected in the funnel 139 is returned by a pump (not shown) to the reservoir 136 through the pipe 141. The slurry collected in the receiver tank 140 is then collected in the waste liquid tank 132. Only the same amount of slurry as that of the slurry drained to the waste liquid tank 132 is fed from the slurry tank 135 to the reservoir 136 by means of the pump 133. This allows the level of the liquid to be kept generally constant in the reservoir 136. That is, the polishing apparatus collects, for recycling, part of the waste liquid that has been used for polishing and drains the remaining waste liquid to the waste liquid tank 132, the remaining waste liquid being then disposed of outside. Thus, part of the slurry 131 is circulated for use.

However, any one of the prior art polishing apparatuses described above needs to be provided with a circulation system for circulating the slurry. This presents a problem of limiting the reduction in cost of facilities in the polishing process .

Furthermore, the polishing apparatus described in Japanese Patent No. 2903980 recycles only part of the waste liquid after polishing. This also presents a problem of limiting the reduction in cost of slurries.

SUMMARY OF THE INVENTION

An object of the present invention is to provide a polishing apparatus which provides reduced processing cost in the polishing process and obviates the need for a slurry circulation system.

The polishing apparatus according to the present invention comprises a polishing pad to be rotationally driven for polishing a ground material; a ground material carrier for sustaining the ground material; slurry feed means for feeding a slurry onto the polishing pad; a filter, disposed upstream from the ground material in a direction of rotation of the polishing pad, for trapping swarf generated on the polishing pad; and a defense barrier, provided around the polishing pad, for retaining the slurry on the polishing pad during polishing, for allowing the slurry on the polishing pad to be drained to outside after polishing is completed.

According to the present invention, the slurry fed onto the polishing pad by the slurry feed means is prevented from spilling out therefrom and thus retained on the polishing pad. Then, the swarf generated during polishing diffuses into the slurry, however, the swarf is trapped by the filter, thereby allowing the ground material to be always ground with a clean slurry from which the swarf has been removed. Then, after the polishing is completed, the slurry on the polishing pad is allowed to flow out therefrom and thus drained. As described above, according to the present invention, the swarf generated on the polishing pad is trapped by the filter on the polishing pad, and the defense barrier retains the slurry on the polishing pad to polish the predetermined number of ground materials. This allows the slurry to be recycled on the polishing pad, thereby reducing the processing cost in the polishing process. Furthermore, according to the present invention, devices such as a circulation system provided for a prior art polishing apparatus for circulating the slurry is not required, except for the polishing apparatus. This reduces the cost of facilities in the polishing process.

In this case, the conditioning portion for conditioning the polishing pad can also be provided on the polishing pad. The conditioning can serve to always maintain the polishing pad under a good polishing condition, and the swarf or the like generated during the conditioning is trapped by the filter.

Furthermore, the projected member, to which the ring-shaped polishing pad fits, is provided at the center of the surface of the base on which the polishing pad is placed. The slurry on the polishing pad is thereby prevented from spilling out therefrom by means of the defense barrier and the projected member, and is thus retained on the polishing pad. That is, the slurry is prevented from spilling out from the ring-shaped polishing pad and allowed to flow in conjunction with the polishing pad.

Furthermore, the defense barrier is preferably supported by the base so as to be tilted outwardly to open further downwardly than the surface of the polishing pad. This makes it easy to drain the slurry.

Still furthermore, the filter can be adapted to be sustained by the ground material carrier and can have a structure of lattice-like multi-layers made of polyester fiber or polyamide fiber.

The nature, principle, and utility of the invention will become more apparent from the following detailed description when read in conjunction with the accompanying drawings in which like parts are designated by like reference numerals or characters.

DETAILED DESCRIPTION OF THE PREFERRED EMBODIMENT

Figure 1:
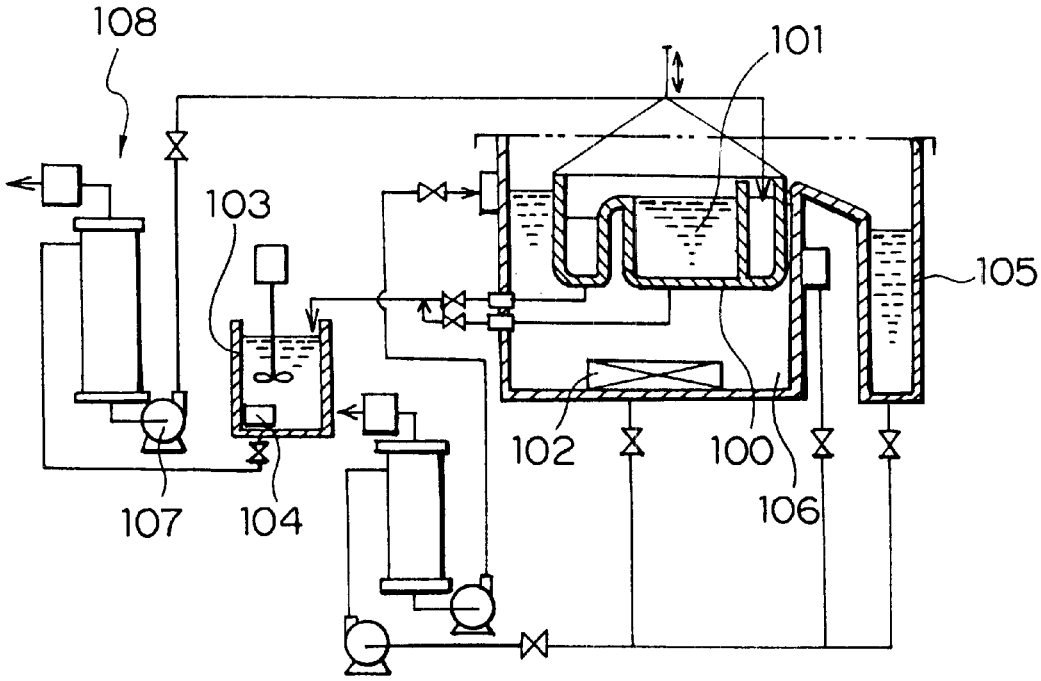
FIG. 1 (PRIOR ART)
FIG. 1 is a schematic view illustrating a prior-art ultrasonic abrasives polishing apparatus.
Figure 2:
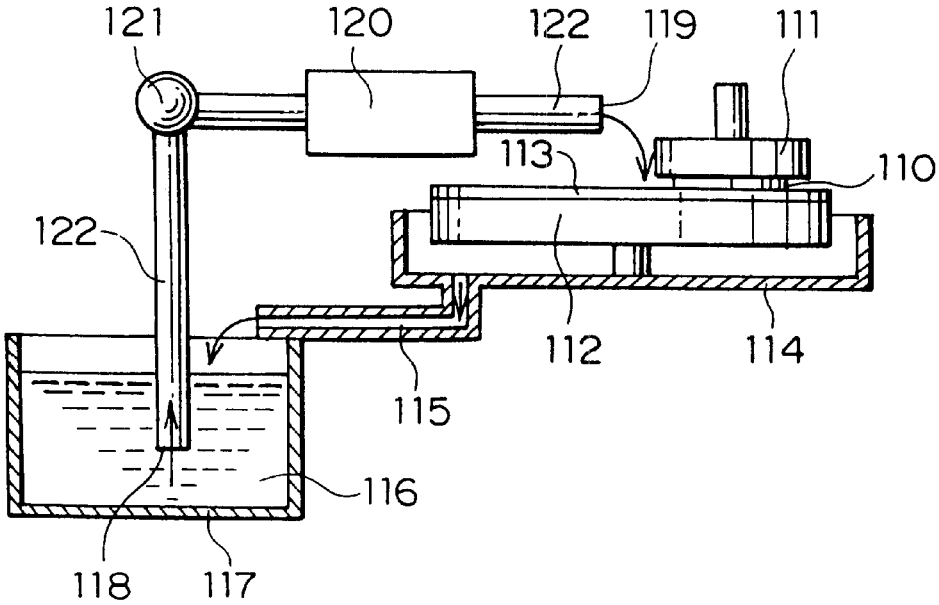
FIG. 2 (PRIOR ART)
FIG. 2 is a schematic view illustrating a prior-art polishing apparatus to be used for semiconductor wafers.
Figure 3:
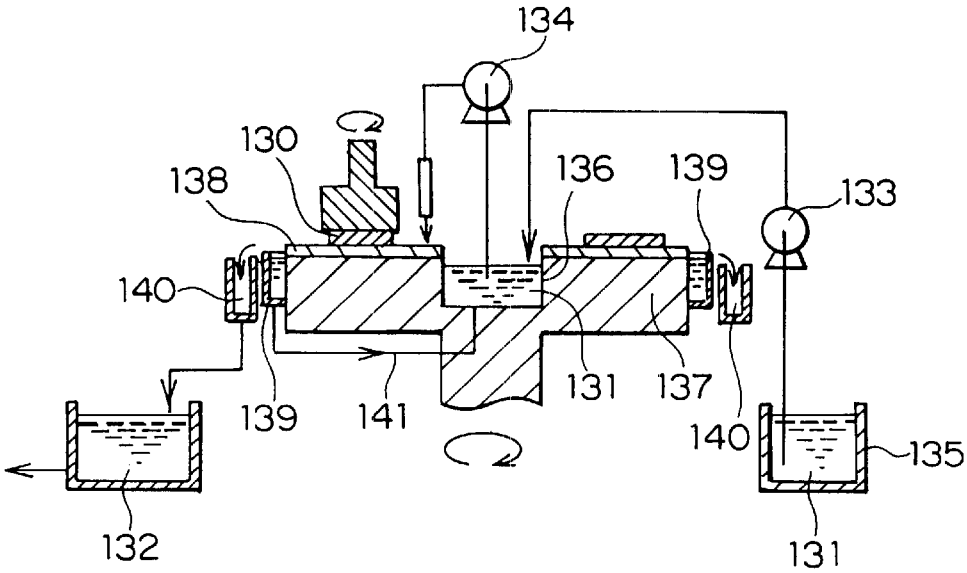
FIG. 3 (PRIOR ART)
FIG. 3 is a schematic view illustrating a prior-art polishing apparatus.
Figure 4:
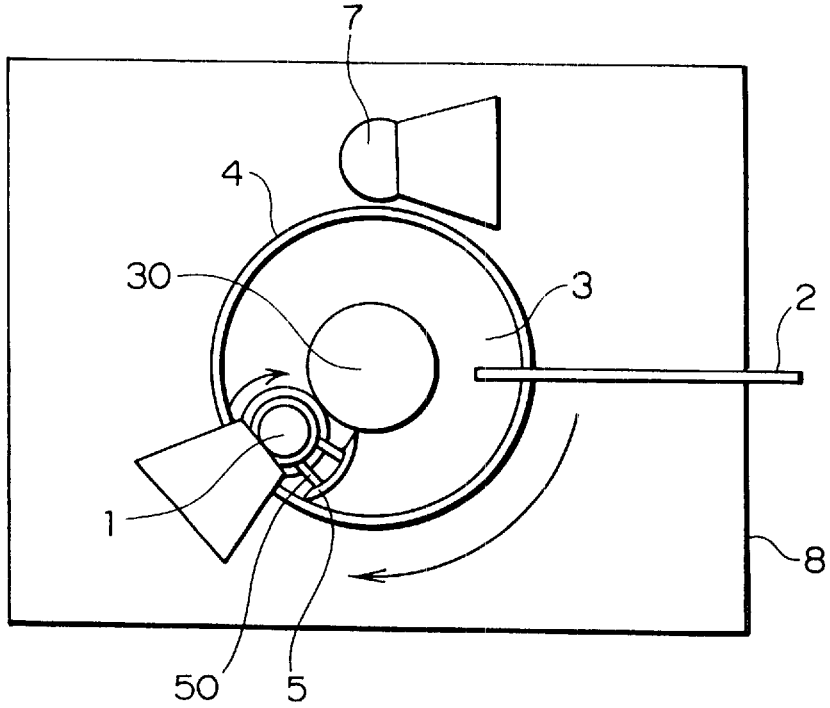
FIG. 4 is a plan view illustrating a polishing apparatus according to an embodiment of the present invention.
Figure 5:
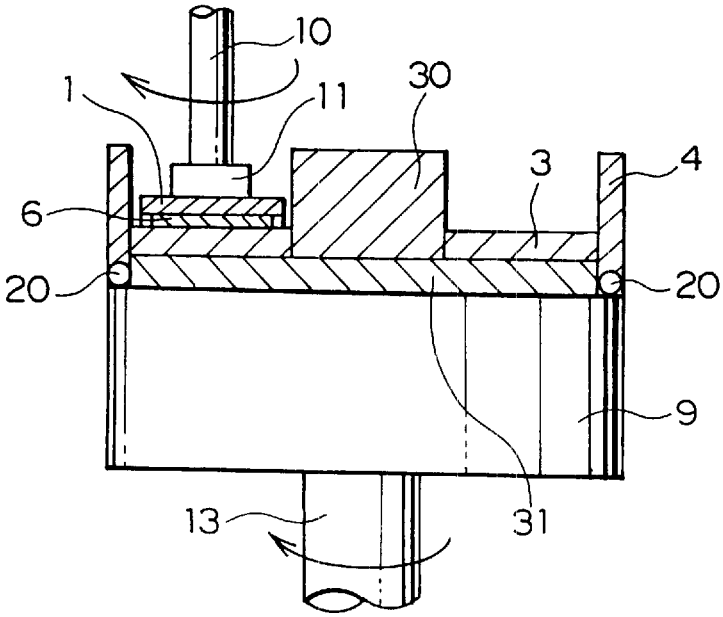
FIG. 5 is a front cross-sectional view thereof.
Figure 6:
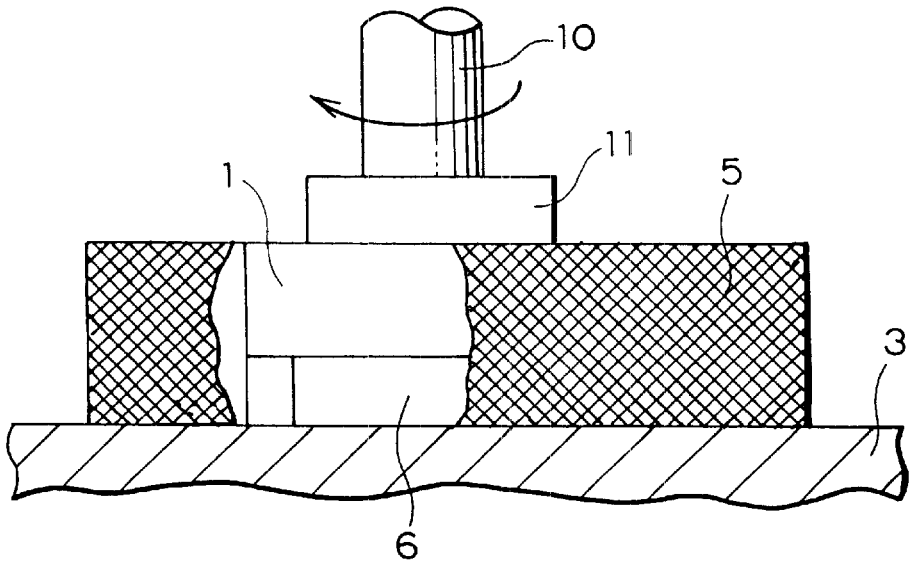
FIG. 6 is a schematic view illustrating the positional relationship between a wafer and a filter, when viewed from the direction of rotation of a polishing pad.
Figure 7:
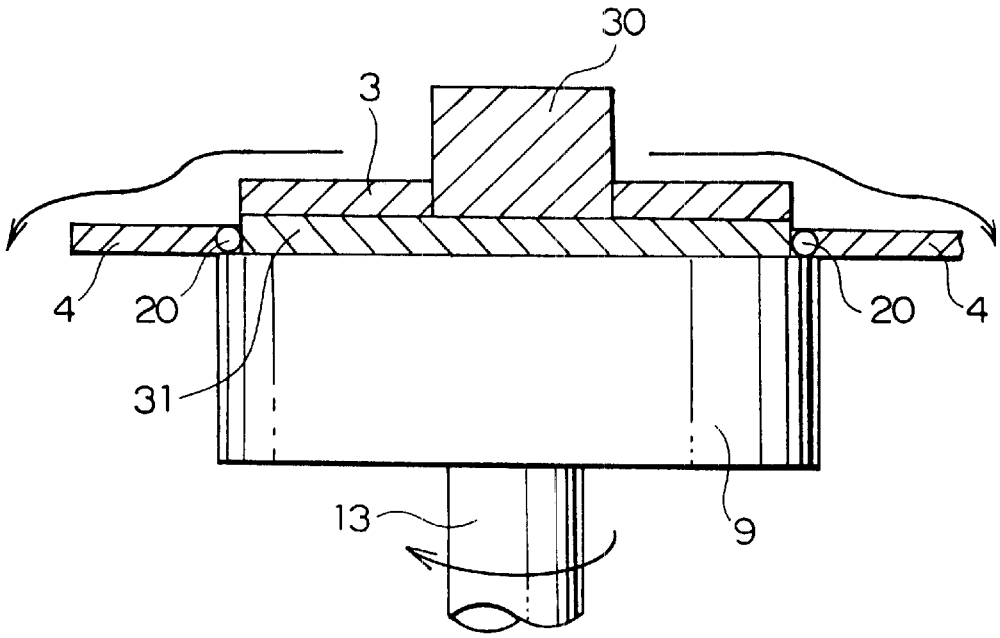
FIG. 7 is a schematic view illustrating the operation of the polishing apparatus according to the embodiment of the present invention.

A polishing apparatus according to an embodiment of the present invention will be explained in detail below with reference to the accompanying drawings. FIG. 4 is a plan view illustrating the polishing apparatus according to the embodiment of the present invention. FIG. 5 is a front cross-sectional view thereof. FIG. 6 is a schematic view illustrating the positional relationship between a wafer and a filter, when viewed from the direction of rotation of a polishing pad. FIG. 7 is a schematic view illustrating the operation of the polishing apparatus according to the embodiment.

As shown in FIGS. 4 and 5, the polishing apparatus according to this embodiment has a disc-shaped platen 9 and a conditioning portion 7 arranged on a base 8. The platen 9 is fixed on a rotary shaft 13 with the center of the platen 9 aligned with that of the rotary shaft 13, the rotary shaft 13 having the center axis disposed vertically. The platen 9 is rotationally driven by appropriate drive means (not shown) via the rotary shaft 13. There is provided a mat 31 on the surface of the platen 9 and a cylindrical projected member 30 at the center of the platen 9 on the mat 31. In addition, there is arranged a ring-shaped polishing pad 3 on the mat 31 so as to fit around the projected member 30.

On the other hand, on the outer circumference rim portion of the platen 9, arranged is a cylindrical defense barrier 4 with the center axis disposed vertically. The defense barrier 4 can be divided into halves. Each of the component members of the defense barrier 4 is supported on the outer circumference rim portion of the platen 9 with a hinge 20 so as to be capable of rolling. This allows the component members of the defense barrier 4 to be combined with each other on the platen 9 to form a cylinder. On the other hand, Each of the component members of the defense barrier 4 is adapted to open by tilting 90 degrees or more when tilted outwardly via the hinge 20 as shown in FIG. 7.

There is disposed a slurry feed nozzle 2 above the platen 9. The slurry feed end is located directly above the ring-shaped area defined by the projected member 30 and the defense barrier 4. This configuration allows the slurry to be fed onto the polishing pad 3 disposed in this area.

A wafer 6 is retained by a wafer carrier 1 and is placed on the polishing pad 3 with the ground surface of the wafer 6 being oriented downwardly. The wafer carrier 1 is fixed to the lower end of a support shaft 10 via a support member 11, the support shaft 10 being adapted to be driven to rotate about the center axis thereof. In addition, the support shaft 10 is supported movably up and down by appropriate support means. Downward movement of the support shaft 10 causes the wafer 6 retained by the wafer carrier 1 to be pressed against and brought into contact with the polishing pad 3. Rotation of the support shaft 10 causes the wafer to rotate about its own axis on the polishing pad 3. Incidentally, the ring-shaped polishing pad 3 is greater in diameter than the wafer carrier 1.

The wafer 6 moves relatively along the polishing pad 3, while rotating about its own axis on the polishing pad 3. There is arranged a filter 5 upstream from the wafer carrier 1 in the direction of rotation of the polishing pad 3. The filter 5 is fixed to the wafer carrier 1 by means of support members 50. For example, the filter 5 has a structure of lattice-like multi-layers made of polyester fibers or polyamide fibers. As shown in FIG. 6, the filter has the lower surface in contact with the surface of the polishing pad 3 and is generally the same in width as the polishing pad 3. Moreover, the filter 5 is adapted to be positioned in the flow of slurry along the entire length of the polishing pad 3.

The conditioning portion 7 is provided with a conditioning disc (not shown) for conditioning (dressing) the polishing pad 3. A support portion of the conditioning disc presses the conditioning disc against the polishing pad 3, and appropriate drive means rotationally drive the conditioning disc to allow the conditioning disc to slidingly rub the polishing pad 3. Incidentally, the conditioning is carried out during polishing on the polishing pad 3 in the presence of a slurry.

Now, the operation of the polishing apparatus according to this embodiment will be explained below. First, the wafer 6 is loaded to the wafer carrier 1 and then the platen 9 is rotated. When polishing is started, a certain amount of slurry is fed onto the polishing pad 3 from the slurry feed nozzle 2. The wafer carrier 1 is lowered, while being rotated, to press the rotating wafer 6 against the polishing pad 3. The slurry fed onto the polishing pad 3 is prevented by the defense barrier 4 and the projected member 30 from spilling out of the polishing pad 3 and thus sustained on the polishing pad 3.

Under this condition, the wafer 6 is ground with the polishing pad 3 and the slurry. The swarf generated from the wafer 6 during the polishing and an impurity such as chippings generated due to wear of the polishing pad 3 are contained in the slurry. The rotation of the polishing pad 3 causes the swarf and the impurity to reach the position of the filter 5, where they are trapped with the filter 5 to be removed from the slurry and the polishing pad 3. Accordingly, the wafer 6 disposed downstream from the filter 5 is always ground with a clean slurry and the grounding quality is not degraded.

Moreover, the conditioning of the polishing pad 3 is carried out in the presence of the slurry on the polishing pad 3 during the polishing of wafer 6. First, the conditioning portion 7 is moved onto the polishing pad 3. Then, the rotating conditioning disc is pressed against the surface of the polishing pad 3 to slidingly rub the surface of the polishing pad 3, thereby carrying out conditioning (dressing) the surface of the polishing pad 3. The conditioning allows the surface of the polishing pad 3 to be maintained under a good condition. At this time, like an impurity such as chippings generated from the wafer 6, the swarf generated from the polishing pad 3 due to the conditioning is also trapped with the filter 5 on the polishing pad 3. Accordingly, the swarf generated from the polishing pad 3 does not have an adverse effect on the polishing of the wafer 6.

Now, the sequence of the polishing process is completed after the predetermined number of wafers 6 have gone through the polishing. Then, the wafer carrier 1 is moved upward, and thereafter the defense barrier 4 is tilted to drain the used slurry on the polishing pad 3 to the outside as shown in FIG. 7.

As described above, in this embodiment, the projected member 30 and the defense barrier 4 are provided on the platen 9. The slurry fed onto the polishing pad is repeatedly used while being prevented from spilling out therefrom. The swarf or the like generated during polishing is filtered out with the filter 5 to polish the wafer 6 always with a clean slurry. Thus, the polishing apparatus provides a good polishing quality and allows the slurry to be repeatedly used. That is, the slurry can be recycled to be used again on the polishing pad 3.

As described above, in this embodiment, the slurry can be recycled on the polishing pad 3, thereby providing reduced processing cost for the polishing process. Furthermore, the polishing apparatus according to the present invention requires no device, except for the polishing apparatus, such as a circulation system provided in a prior-art polishing apparatus for circulating slurries, thereby providing reduced cost for facilities in the polishing process.

In addition, according to this embodiment, the defense barrier 4 is pivoted 90 degrees outwardly to be generally parallel to the surface of the polishing pad 3, thereby making it easy to drain the slurry. Furthermore, according to this embodiment, the defense barrier 4 and the projected member 30 restrict the flow of the slurry to one direction, thereby allowing the filter 5 to filter only the flow in that direction and thus making it possible to simplify the shape of the filter 5.

Furthermore, according to this embodiment, the polishing pad 3 is formed in the shape of a ring. However, the present invention is not limited thereto and any shape may be employed so long as the shape allows the slurry to flow onto the wafer 6. In this case, the filter 5 should be located upstream from the wafer 6 along the flow of slurry. Still furthermore, according to the present invention, the structure of the defense barrier 4 is not limited to a particular one. Any other structure that does not have the hinge 20 may be employed so long as the structure prevents the outflow of slurry and allows the slurry to be drained when required.

Incidentally, according to the present invention, the wafer 6 is employed as the material to be ground. However, the present invention is not limited thereto and for example, substrates made of aluminum or aluminum alloy can be ground.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A polishing apparatus comprising:

a polishing pad to be rotationally driven for polishing a ground material;

a ground material carrier for sustaining said ground material;

slurry feed means for feeding a slurry onto said polishing pad;

a filter, disposed upstream from said ground material in a direction of rotation of said polishing pad, for trapping swarf generated on said polishing pad; and a defense barrier, provided around said polishing pad, retaining said slurry on said polishing pad during polishing, allowing said slurry on said polishing pad to be drained to outside after polishing has been completed.

2. The polishing apparatus according to claim 1, further comprising a conditioning portion for conditioning said polishing pad.

3. The polishing apparatus according to claim 1, further comprising:

a base for placing said polishing pad thereon; and a projected member projecting toward said polishing pad at the center of a surface of said base, wherein said polishing pad is formed in a shape of a ring to fit to said projected member.

4. The polishing apparatus according to claim 2, further comprising:

a base for placing said polishing pad thereon; and a projected member projecting toward said polishing pad at the center of a surface of said base, wherein said polishing pad is formed in a shape of a ring to fit to said projected member.

5. The polishing apparatus according to claim 3, wherein said defense barrier is supported by said base so as to be tilted outwardly to open further downwardly than the surface of said polishing pad.

6. The polishing apparatus according to claim 4, wherein said defense barrier is supported by said base so as to be tilted outwardly to open further downwardly than the surface of said polishing pad.

7. The polishing apparatus according to claim 1, wherein said filter is supported by means of said ground material carrier.

8. The polishing apparatus according to claim 1, wherein said filter has a structure of multi-layers.

9. The polishing apparatus according to claim 1, wherein said filter is made of a member selected from the class consisting of polyester fiber and polyamide fiber.

* * * * *